United States Patent [19]

Vaplon et al.

[11] 4,102,502

[45] Jul. 25, 1978

[54] CONCENTRATION OF PLATE-SHAPED MINERALS

[75] Inventors: Gary Gene Vaplon; Edwin Erickson, both of Libby, Mont.; Joseph L. Young, Santo Domingo, Dominican Republic

[73] Assignee: W. R. Grace & Co., Cambridge, Mass.

[21] Appl. No.: 749,237

[22] Filed: Dec. 10, 1976

[51] Int. Cl.[2] ..... B02B 23/18

[52] U.S. Cl. ..... 241/4; 241/15; 209/2; 209/106

[58] Field of Search ..... 209/45, 2, 10, 233, 209/106, 103, 101, 261, 263; 106/DIG. 13; 241/4, 15

[56] References Cited

U.S. PATENT DOCUMENTS

| | | | |
|---|---|---|---|
| 1,716,758 | 6/1929 | Bland | 209/2 |
| 1,941,212 | 12/1933 | Johnson | 209/2 |
| 1,950,829 | 3/1934 | Thomson | 241/4 |
| 2,058,959 | 10/1936 | Denning | 209/2 |
| 2,971,703 | 2/1961 | Rath | 241/24 |
| 3,009,570 | 11/1961 | Lancaster et al. | 241/4 X |
| 3,438,491 | 4/1969 | Haley et al. | 209/106 |

*Primary Examiner*—Bernard Nozick
*Assistant Examiner*—Ralph J. Hill
*Attorney, Agent, or Firm*—William L. Baker; C. E. Parker.

[57] ABSTRACT

Minerals, which when mined are recovered in plate-shaped form, such as vermiculite, are efficiently concentrated in a process wherein the mined ore is passed over a series of revolving spaced rolls. Various preferred aspects of the process such as the use of rubber covered rolls, rolls having different spacing therebetween, etc., are also described.

14 Claims, 5 Drawing Figures

FIG. 1
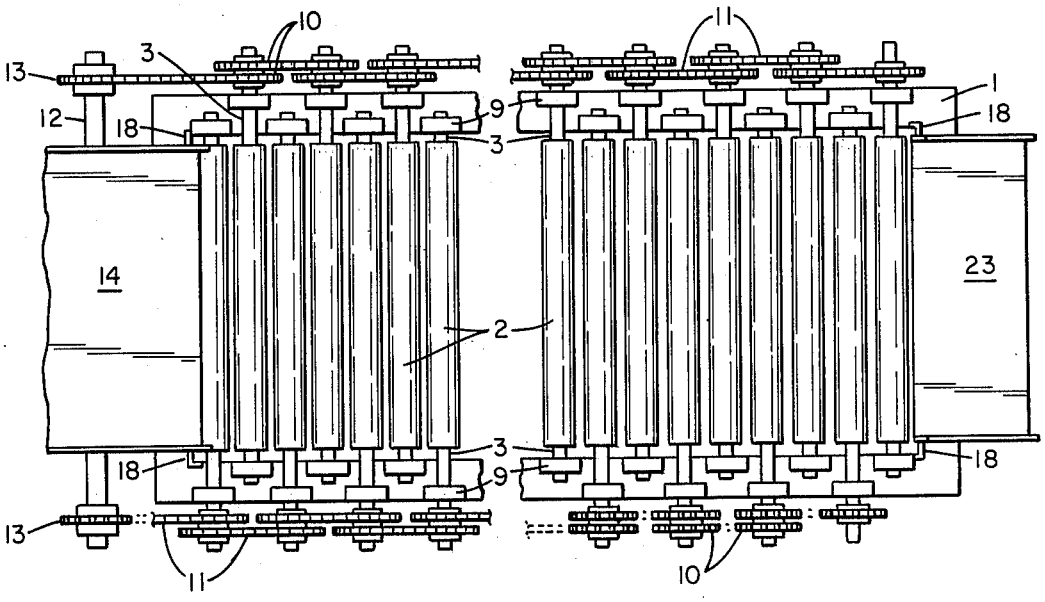
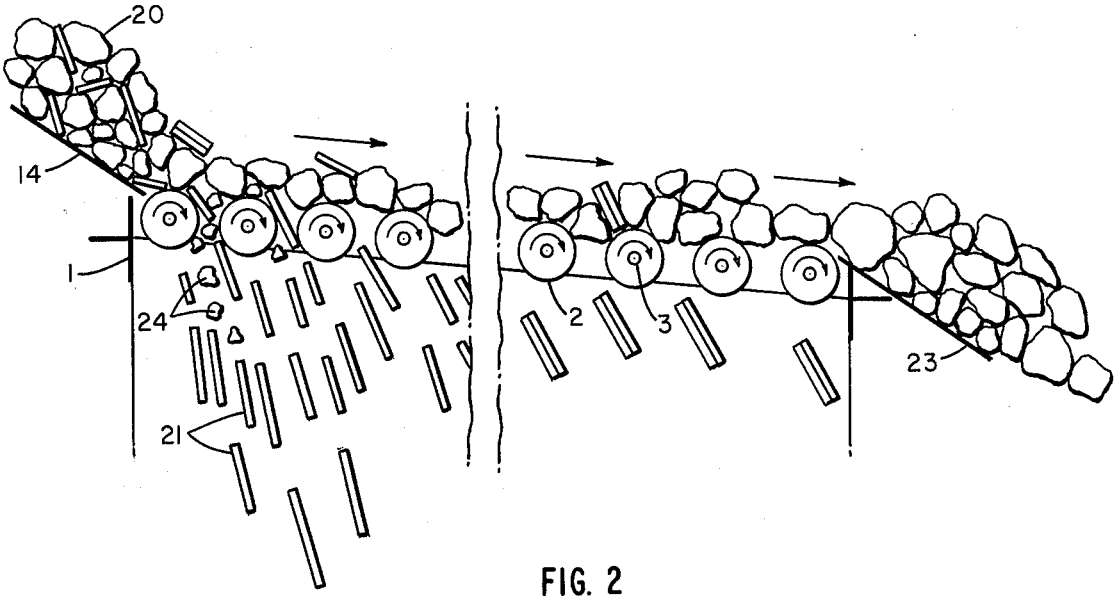
FIG. 2

FIG. 3
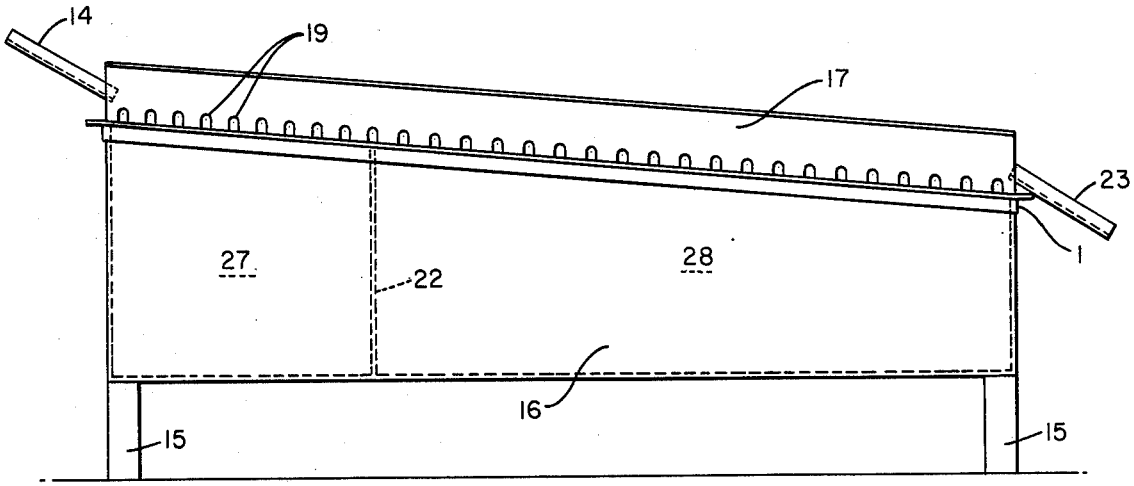
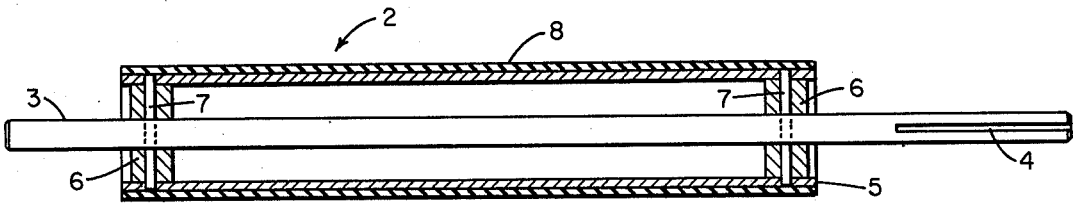
FIG. 4

CONCENTRATION OF PLATE-SHAPED MINERALS

BACKGROUND OF THE INVENTION

This invention relates to a method of concentrating minerals which when mined are recovered in plate-shaped form. More particularly, this invention pertains to an improved, highly efficient process for concentrating and sorting plate-shaped minerals such as vermiculite and other micas which are recovered in admixture with non-plate like gangue materials such as rocks, etc.

Vermiculite is a mineral of micaceous origin having the very desirable property of exfoliating or expanding when heated to a state many times its original size and density to form a lightweight, inert, highly porous aggregate material of many uses. As mined, the mineral is recovered in its characteristic "plate-like" shape in association with gangue rocks and minerals such as feldspar, quartz, diopside, etc.

Many processes for concentrating or for separating vermiculite from other constituents found in vermiculite ore are described in the art. Such procedures range from simple screening with vibrating screens having varying sized and shaped openings to relatively more sophisticated processes involving treatment with chemicals, etc. or combination of such.

For many years, the processes commercially applied have proceeded with an initial separation of the mined vermiculite ore into "coarse" and "fine" fractions, with subsequent markedly different treatment of the sized fractions thereafter. The "coarse" fraction was usually concentrated by screening using various types of screen cloth on vibrating screens. Treatment of the "fine" fraction utilized conventional "froth flotation" techniques to recover a concentrate rich in vermiculite.

One type of screen employed in the past to concentrate the coarse vermiculite ore fraction was the "slot" screen. This screen had openings which were in the form of slots dimensioned such that only plate-like particles could pass edgewise therethrough. This screen however was subject to "blinding", that is, blocking up of the slots by particles which were not exactly oriented or aligned with the slots. Also the degree of concentration obtained with this device depended upon the presence of more plate-like material in the feed than granular material, and in turn more of the plate-like material being vermiculite particles than non-vermiculite platelets.

The inefficiencies of the slot screen led to the substitution of the so called "plate" separator for the slot screen in the coarse vermiculite processing circuit. The plate separator consists of an inclined rubber covered plate with two adjacent discharge compartments located near the bottom end of the inclined plate, cone compartment being positioned further away from the plate than the other. The coarse feed is introduced to the top of the plate and allowed to travel freely down the incline. Rock and other unwanted constituents of the ore bounce off of the plate and into the discharge compartment located furthest from the board, while the plate-shaped vermiculite particles tend to adhere to the plate surface and drop into the closer discharge compartment.

The "plate" separator is simple in design with no moving parts. However, continuous adjustment of a discharge "splitter" located at the lower end of the inclined plate is required in order to compensate for the variances in feed rate and feed characteristics. Also, the plate separator is not so efficient as to produce a product rich enough to be a final concentrate, and thus is used only as a "rougher", generating a middling for further processing.

SUMMARY OF THE INVENTION

We have found that the so called "roll screening" technique such as has been previously employed to convey, size or classify such materials as iron ore, vegetable produce, etc., is a highly efficient technique for concentrating plate-shaped minerals such as vermiculite from ore containing such minerals in admixture with other non-plate shaped gangue minerals naturally occuring therewith. According to our invention, the vermiculite ore mixture is passed over a bed formed by a plurality of rotating rolls arranged longitudially and in series, each of the rolls being spaced from one another and rotating in the same direction. The vermiculite plates pass through the spaces between the rolls, while non-plate shaped gangue particles are rejected therefrom and carried away by the rotating rollers.

Surprisingly, this roll screening technique has been found to be highly specific for the plate-like vermiculite particles leading to the recovery of a product exceptionally rich in vermiculite. It is theorized that the vermiculite plates because of their shape tend to adhere along their flat surface to the surface of the roll, and thus become aligned or oriented for passage edgewise between the spaces of the rolls. This fact, plus the fact that the roll screen device is essentially self-cleaning, avoids the problems of "blinding" attendant the use of slot screen mentioned above. Moreover, it has been observed that to a degree even unwanted rock particles which are smaller than the space between the rolls are rejected from such space due to the preferential bouncing of the rock particles on the rotating rollers.

Another advantage of the roll screening technique lies in the fact that the speed of the rolls can be adjusted in order to optimize separation and also to compensate for wearing of the roller surfaces. Further, the roll screen has been found to have a high dewatering capability should the separation be carried out with the addition of water.

The unexpected high efficiency of the roll screen process for separating the plate-shaped vermiculite particles has provided a more efficient substitute for the plate separator previously employed in the commercial processing of vermiculite. When so substituted, our process can produce a product sufficiently rich in vermiculite for final concentration with sizing, as compared to the less rich "middling" grade produced hitherto by the plate separator. There is also obtained the additional benefit of the production of a final concentrate of coarse flakes, as compared to the "middling" from the plate separator which required a reduction in particle size as part of its beneficiation. Because of product of the plate separator contained a comparatively large content of rock, it had to be ground in a rod mill which produced not only a fine sized rock which had to be removed by further processing, but also produced a finer sized vermiculite particle. As a matter of economy, the coarse vermiculite product recovered in the process of this invention is preferable to equipment recovery of finer sized vermiculite product. By eliminating the grinding of a middling product, overall mill performance is improved in the minus 8 mesh sizes since the creation of additional amounts of fine rock requiring further processing is avoided.

BRIEF DESCRIPTION OF THE DRAWINGS

FIG. 1 is a top plan view of a roll screen apparatus for carrying out the process of the invention;

FIG. 2 is a somewhat diagrammatic side view illustrating the passage of vermiculite ore through the roll screen apparatus of FIG. 1;

FIG. 3 is a side plan view of the apparatus shown in FIG. 1 having sides thereon;

FIG. 4 is a section of a roll employed in the apparatus of FIG. 1; and

DESCRIPTION OF THE PREFERRED EMBODIMENT

Figure 5:
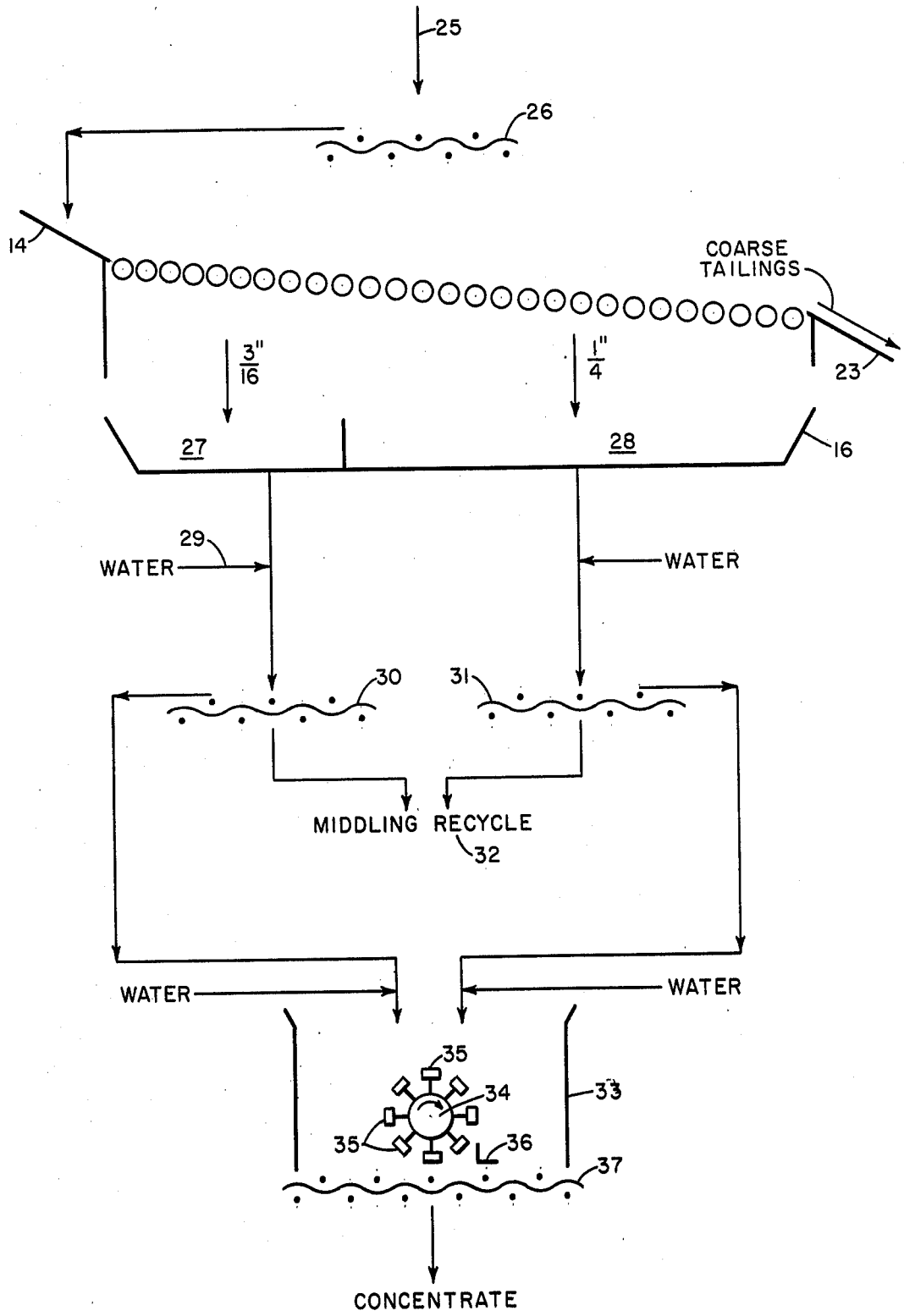
FIG. 5 is a schematic outline in diagrammatic fashion of a preferred process according to the invention.

Our process is best described in connection with the preferred apparatus for carrying out the process shown in the attached drawings. In FIG. 1, a frame 1 supports a series of rolls 2 mounted thereon, the axes of the rolls lying in a plane generally parallel to the frame. The rolls 2 as best shown in section in FIG. 4, each have a 1 inch diameter metal shaft 3 approximately 64 inches long. The shaft has one long end protuding from the roll which has a one quarter inch square keyway 4, 8 inches in length. The shaft 3 carries a 2 inch diameter pipe 5, spaced from the shaft by metal plugs 6 at the ends thereof. The pipe is kept in place on the shaft by shear pins 7, one quarter inch in diameter. The pins 7 are bored through the metal pipe 5, the plugs 6 and the shaft 3. The pipe has a gum rubber covering 8 approximately five sixteenths of an inch in thickness.

The rolls 2 are journaled on both ends via bearing supports 9 bolted to frame 1. The securement of the bearing supports 9 to the frame 1 is preferably such that the width between the rolls is adjustable to compensate for wearing of the rubber covers. The rolls 2 are mounted such that the long ends of shafts 3 having keyways 4 thereon extend beyond the edge of frame 1. This is to provide space for a pair of 5 inch diameter sprocket wheels 10 into which each keyway fits. The rolls 2 are further positioned upon the frame such that the ends of each roll carrying the sprocket wheels 10 are alternately staggered with respect to one another on opposite sides of frame 1 as shown in FIG. 1. This again is to provide sufficient space for the comparatively larger diametered sprocket wheels.

The positioning of the sprocketed ends of each successive roll on opposite sides of frame 1 requires two separate chain drives, one on each side of the frame 1. The chain drive may be a single continuous chain, but we prefer to use a number of separate continuous chains 11 each connecting but two of the rolls in order to have a more positive drive. A common axel 12 arranged generally parallel with the shafts 3 of rolls 2 has a sprocket wheel 13 at each end thereof for engagement with the first nearest sprocket wheel 10 on each side of frame 1. The axel 12 is driven by an electric motor not shown in the drawings. Vermiculite ore is delivered to the upper surface of the first roll via chute 14.

In FIG. 3 the apparatus of FIG. 1 is depicted as viewed from the side, as further having supports 15, a collecting bin 16 with divider 22 and side member 17 on each side of frame 1 to prevent the ore from moving laterally off of the rolls 2. The sides 17 fit snugly against the rubber covered rolls, and also abutt the frame 1 along their lower edge. The sides are bolted to the upstanding corner braces, 18, in FIG. 1, which are welded to the frame 1. The apparatus has a discharge chute 23 similar to chute 14 at the opposite end of the roll bed. The side members 17 as shown in FIG. 3 have slots 19 therein to allow for passage of the shafts 3 therethrough.

As shown in FIG. 3, the roll bed and frame 1 carrying such is preferably angled to the horizontal, for example 10°, to give a slight pitch to the bed downward from the entry chute 14.

Operation of the device is illustrated in FIG. 2. The vermiculite ore 20 containing both vermiculite in platelet form 21 and non-plate shaped gangue material, e.g. rocks, etc., is introduced to the roll bed via chute 14. The rolls are all rotating in the same direction as shown, i.e. towards the discharge end, which may have a discharge chute 23. The distance between the rolls is such that the vermiculite plates 21 are allowed to enter but the non-plate shaped rock, etc., will bounce and be conveyed over the surfaces of the rolls to the discharge end. While some rock 24 having a diameter less than the width of the slot will pass through the slot, our experience has been that much of such rock will be bounced along by the speed and rotation of the rolls and be discharged at the end.

In the preferred embodiment of our apparatus, we employ 30 gum rubber-lined rolls. The spacing between the first one third (10) rolls of the device is set at three sixteenths of an inch. The second two thirds (20 rolls) are spaced one quarter of an inch apart. These settings were determined by experimentation to be most suitable for ore feed size of generally minus ½, plus ¼ inch, although some feed material may be as large as 2½ inches. The thinner "books" of vermiculite particles in the feed will pass through the first 10 rolls, while the thicker "books" will be moved along, and will be able to pass through the spaces of the second 20 rolls, as illustrated in FIG. 2. As aforementioned, the spacing is preferably made adjustable to compensate for wear of the rubber-covered rolls. Gum rubber was found to outlast both metal and non-gum rubber roll covers by about a 50 to 1 ratio. Other advantages of the rubber covering include (a) improved sound insulation; (b) improved "bouncing" of the rock which aids in separation and transportation of the non-plate shaped materials; (c) ease of replacement is possible since a rubber tube can be used as a covering which is easily replaced on site and; (d) the rubber covering provides a good seal between the rolls and the metal sides of the apparatus.

The high selectivity of the roll screen device for the plate shaped vermiculite particles results in a vermiculite product high in vermiculite content. In a commercial operation, the product need only be sized, and undersized material present originally in the feed removed in order to give a high final concentrate grade. The separation is very predictable and consistent compared to past technique.

In FIG. 5, there is diagrammatically illustrated a particularly preferred method of obtaining such a high concentrate grade of vermiculite product in a commercial operation.

The mined ore 25 after removal of large boulders, etc., is screened on a conventional vibrating screen 26 of well known construction ("Derrick" a trademark of The Derrick Manufacturing Corporation) having three mesh square openings. The product retained thereon (minus 2½ inch plus 3 mesh) is deposited via chute 14 onto the roll screen device shown in FIG. 2. The product passing through the 3 mesh vibrating screen (minus 3 mesh) is led away for further processing which forms no part of the present invention.

The product from chute 14 is deposited onto the first concentrating zone of the roll screen device consisting of the ten rolls spaced three sixteenths of an inch apart. The plates of vermiculite passing through the spaces in this zone are collected in a first compartment 27 of collecting bin 16. The product passing through the second concentration zone of rolls spaced one quarter inch apart is collected in compartment 28 of bin 16. Non plate-shaped rocks and other gangue material are recovered from the end of the screen via chute 23 as coarse tailings.

The vermiculite product collected in compartment 27 is conducted via a gravity fed pipe onto a square mesh vibrating screen 30 ("AERO-VIBE") having five sixteenths of an inch openings therethrough. Water is added to this pipe via line 29 before such is deposited onto the screen 30 to aid in the screening.

In similar fashion, the vermiculite from the quarter inch spaced rolls collected in compartment 28 of bin 16 is piped onto an "AERO-VIBE" square mesh vibrating screen 31, the size of openings in this instance however being larger, one half of an inch. Again water is added to the pipe prior to deposition on the screen.

The oversize vermiculite plates retained on screens 30 and 31 are conducted to a size-reducing apparatus in order to obtain a commercially desired size. Large sized particles of vermiculite are more difficult to expand by heating. Thus reducing the size of vermiculite particles or "books" to a desired size gives a product which will expand more uniformly in a subsequent heat-expanding operation. We prefer to use a hammer mill 33 for this size-reducing operation. Hammer mills of this type are well known in the art and have been employed for this purpose previously. Such mills generally comprise an elongated shaft 34 in FIG. 5 to which are hinged a plurality of "hammers" 35 which when in operation are extended outward from the shaft by the centrifugal force of the rotating shaft. The vermiculite particles are hammered against an anvil 36 spaced from the shaft 34. This spacing of the anvil is adjustable and in this manner the extent of size reduction can be regulated. Properly sized vermiculite particles are passed through screen 37 as concentrate. The fine material 32 passing through screens 30 and 31 is recycled to the top of another processing circuit not shown, some of which may return to the roll screen device. We have found that the addition of water to the hammer mill during the milling operation is highly desirable in that it reduces the amount of "fines" produced giving a greater yield of concentrate in the desired size range.

The removal of "fines", that is, undesired rocks, etc., present in the original feed and having a size smaller than the spaces between rolls 2, from the vermiculite product passing through the rolls can be accomplished by means other than screens 30-31. For example, the fines could be removed by "jigging" the vermiculite product from rolls 2, a conventional technique well known in the art, although this would not be as economically practical as the use of the square mesh vibrating screens.

While the invention has been described in connection with the separation and concentration of vermiculite ore, it is apparent that the process may be employed to separate and concentrate other plate-like mineral ores, in particular other mica minerals such as biotites in general, muscovite, pholgopite, etc.

What we claim is:

1. The method of separating minerals which when mined are in the form of plate-shaped particles from other non-plate shaped constituents of the mined mineral ore, said method comprising the steps of;

(a) providing a bed formed by the surfaces of a plurality of spaced rotating rolls arranged generally horizontally along one side another, the axes of said rolls being substantially parallel and the direction of rotation of each roll being the same;

(b) depositing said mined mineral ore onto said bed of rolls;

(c) aligning the flat surfaces of said plate-shaped particles along the surfaces of said rotating rolls thereby causing a substantial portion of said plate-shaped mineral particles in said mined ore to pass through the spaces between said rolls while at the same time conveying a substantial proportion of said non-plate shaped constituents of said ore along the surfaces of said rolls in the direction of rotation of said rolls, and (d) collecting the said plate-shaped mineral particles passing through said spaces in a zone beneath said bed of rolls, and collecting said non-plate shaped constituents in a zone near the end of said bed.

2. The method of claim 1 wherein said mineral is a mica.

3. The method of claim 1 wherein said plate-shaped mineral is vermiculite and said ore is mined vermiculite ore.

4. The method of claim 1 wherein said bed of rolls is divided into at least two zones, a first such zone being a zone onto which said ore is initially deposited and being comprised of a number of the said rolls in sequence and having an identical spacing, the second such zone being a zone onto which said ore is deposited from said first zone and being comprised of a number of other of said rolls also in sequence and also having an identical spacing, the spacing between the rolls in said second zone being greater than the spacing between the rolls in said first zone.

5. The method of claim 1 wherein the rolls have gum rubber surfaces.

6. The method of claim 1 wherein the axes of said rolls are at an angle to the horizontal such that the bed of rolls pitches downwardly from the point at which the mined ore is deposited.

7. The method of concentrating vermiculite ore comprising the steps of;

(a) providing a bed formed by the surfaces of a plurality of spaced rotating rolls arranged generally horizontally along one side another, the axes of said rolls being substantially parallel and the direction of rotation of each roll being the same; said bed further being comprised of first and second zones, said first zone being comprised of a number of said rolls in sequence and having an identical spacing, said second zone being comprised of a number of other of said rolls in sequence and having an identical spacing, the distance between the rolls in said second zone being greater than the distance between the rolls comprising said first zone;

(b) depositing said vermiculite ore onto the surfaces of the rolls comprising said first zone of said bed and conveying said ore along the surfaces of the rolls in the said first zone to the surfaces of the rolls comprising said second zone of said bed;

(c) aligning the flat surfaces of the plate-shaped vermiculite particles in said ore along the surfaces of the rotating rolls in said first and second zones thereby causing a substantial portion of the vermiculite in the said ore to pass through the spaces between the said rolls of said bed; and (d) collecting the said vermiculite passing through said spaces in a zone beneath said bed of rolls, and collecting the remainder of said ore from said second zone of said rolls in the said bed.

8. The method of claim 7 wherein said bed of rolls is pitched downwardly from said first zone of rolls in a direction towards said second zone of rolls.

9. The method of concentrating vermiculite ore comprising the steps of;

(a) providing a bed formed by the surfaces of a plurality of spaced rotating rolls arranged generally horizontally along one side another, the axes of said rolls being substantially parallel and the direction or rotation of each roll being the same; said bed further being comprised of first and second zones, said first zone being comprised of a number of said rolls in sequence and having an identical spacing, said second zone being comprised of a number of said rolls in sequence and having an identical spacing, the distance between the rolls comprising said second zone being greater than the distance between the rolls comprising said first zone;

(b) depositing said vermiculite ore onto the surfaces of the rolls comprising said first zone and conveying said ore along the surfaces of such rolls to the surfaces of the rolls comprising said second zone of said bed;

(c) aligning the flat surfaces of the plate-shaped vermiculite particles in said ore along the surfaces of said rotating rolls in said first and second zones thereby causing a substantial portion of the vermiculite in said ore to pass through the spaces between the rolls of said bed, a first vermiculite concentrate being formed of the material passing through the spaces of the rolls comprising said first zone, a second vermiculite concentrate being formed of the material passing through the spaces of the rolls comprising said second zone;

(d) screening the said first vermiculite concentrate on a screen having square shaped openings therethrough of uniform size, and screening the said second vermiculite concentrate on a second screen having square shaped openings therethrough of uniform size also, the openings through the said second screen being of greater dimension than the said openings through the said first screen; and thereafter (e) reducing the size of the vermiculite particles retained on said screens to a desired dimension.

10. The method of claim 9 wherein water is added to the said first and second concentrates prior to passage through said screens.

11. The method of claim 9 wherein the rolls comprising said first zone are spaced three sixteenths of an inch apart, the rolls comprising said second zone are spaced one quarter inch apart, the openings through said first screen are five sixteenths of an inch wide, and the openings through said second screen are one half of an inch in width.

12. The method of claim 9 wherein said size reduction of said vermiculite particles is accomplished by hammer milling of the particles.

13. The method of claim 12 wherein the hammer milling of said vermiculite particles is carried out with the addition of water to the particles.

14. The method of concentrating ore containing micaceous, plate-shaped mineral particles said method comprising the steps of;

(a) providing a bed formed by the surfaces of a plurality of spaced rotating rolls arranged generally horizontally along one side another, the axes of said rolls being substantially parallel and the direction of rotation of each roll being the same.

(b) depositing said ore onto said bed of rolls;

(c) aligning the flat surfaces of said plate-shaped particles along the surfaces of said rotating rolls thereby causing a substantial portion of said plate-shaped mineral particles in said mined ore to pass through the spaces between said rolls while at the same time conveying a substantial proportion of said non-plate shaped constituents of said ore along the surfaces of said rolls in the direction of rotation of said rolls, and thereafter (d) separating any non-plate shaped particles also passing through said rolls from the plate-shaped mineral particles.

* * * * *